US006869321B1

(12) United States Patent
Ashby et al.

(10) Patent No.: US 6,869,321 B1
(45) Date of Patent: Mar. 22, 2005

(54) DUAL FEMALE ELECTRICAL CONNECTOR AND CONNECTOR MODULE

(75) Inventors: Darryl Marshall Ashby, Weyers Cave, VA (US); Jeffery Paul Stowers, Mount Sidney, VA (US); David Lawrence Rocker, Charlottesville, VA (US)

(73) Assignee: Virginia Panel Corporation, Waynesboro, VA (US)

( * ) Notice: Subject to any disclaimer, the term of this patent is extended or adjusted under 35 U.S.C. 154(b) by 31 days.

(21) Appl. No.: 10/608,144

(22) Filed: Jun. 30, 2003

(51) Int. Cl.[7] ..... H01R 11/22

(52) U.S. Cl. ..... 439/851; 439/873; 439/246; 439/654

(58) Field of Search ..... 439/851, 873, 439/246, 252, 650, 651, 654, 638, 852, 853, 854, 856, 696, 686

(56) References Cited

U.S. PATENT DOCUMENTS

| | | | | | |
|---|---|---|---|---|---|
| 2,603,681 | A | | 7/1952 | Salisbury | |
| 3,034,093 | A | | 5/1962 | Blain | |
| 3,140,139 | A | * | 7/1964 | Urban | 439/686 |
| 3,346,834 | A | | 10/1967 | Kinkaid | |
| 3,386,072 | A | * | 5/1968 | Chandler | 439/686 |
| 3,482,201 | A | | 12/1969 | Schneck | |
| 3,732,529 | A | * | 5/1973 | Weisenburger | 439/525 |
| 3,853,389 | A | | 12/1974 | Occhipinti | |
| 4,284,320 | A | * | 8/1981 | Nix et al. | 439/686 |
| 4,813,881 | A | | 3/1989 | Kirby | |
| 4,874,338 | A | * | 10/1989 | Bakermans | 439/851 |
| 5,037,332 | A | | 8/1991 | Wilson | |
| 5,096,434 | A | | 3/1992 | Byrne | |
| 5,242,319 | A | | 9/1993 | Ju | |
| 5,334,035 | A | * | 8/1994 | Wehrle et al. | 439/252 |
| 5,383,800 | A | | 1/1995 | Saka et al. | |
| 5,667,409 | A | | 9/1997 | Wong et al. | |
| 6,030,241 | A | | 2/2000 | Chiba | |
| 6,315,591 | B2 | * | 11/2001 | Oda et al. | 439/252 |
| 6,394,829 | B1 | * | 5/2002 | Patterson et al. | 439/252 |

* cited by examiner

*Primary Examiner*—Ross Gushi
(74) *Attorney, Agent, or Firm*—DeWitt Roggin, PLLC; Timothy DeWitt

(57) ABSTRACT

A connector and module provide for mating at least two connectors having pinned interfaces. The connectors provide a socket having reliable electrical contact and a pin socket with reliable pin alignment. An interface for multiple input modules with reliable electric contact and pin alignment is also described. A gimbal feature allows the connector to more easily self-align with mating pin structures.

5 Claims, 7 Drawing Sheets

DUAL FEMALE ELECTRICAL CONNECTOR AND CONNECTOR MODULE

BACKGROUND OF THE INVENTION

1. Field of the Invention

The present invention relates to devices, systems, and processes useful as electrical connectors, and more specifically to electrical connectors useful in mass interconnect systems.

2. Brief Description of the Related Art

Complex electronic systems, such as those found in computers, cars and airplanes, etc., undergo rigorous testing. During design, development, production, and maintenance, engineers must test both critical performance characteristics and the over-all functioning of such devices. Interface test connectors and adapters are used to join complex systems with test equipment at a common interface.

Output from both a unit under test and test equipment comes from pinned, or male, interfaces. Thus, a connector for mating male interfaces is needed. Further, multiple devices may require either a single pin or multiple pin connection. Multiple pin inputs may come from a structured connector, such as a ribbon cable, where pins are mounted on a plate resting on the interface. This type of input connector structure helps provide stability. However, single pin connections have no outside structure and are susceptible to being wiggled or moved from the weight of the wire or from contact by someone working at the interface. Pin movement can interrupt signal transmission and ruin testing. Thus, a connector for a complex system must provide a high fidelity contact between pins regardless of other connector structures and resulting stability.

Known electrical connectors are now described. U.S. Pat. No. 5,242,319 to Ju entitled "Electrical Connectors" issued Sep. 7, 1993, (the '319 patent) describes a three row connector having two rows of lateral terminals 12, one row of intermediate terminals 11, and, in one embodiment, female to female contacts 122, 122'. FIG. 1 of the '319 patent illustrates a small-scale connector.

U.S. Pat. No. 5,037,332 to Wilson entitled "Intermodule Electrical Coupling" issued Aug. 6, 1991, describes an interface module 10 having sockets 40, 42 for receiving pins 16, 18. Bushings 54, 56 direct pin placement to prevent socket contacts 36 from contacting plated walls 72, which are grounded EMI shields, causing short-circuiting (col. 2, l. 59- col. 3, l. 5).

U.S. Pat. No 5,383,800, to Saka, et al., entitled "Relay Terminal For Use in Branch Connecting Box" issued Jan. 24, 1995 (the '800 patent). FIGS. 1*a* and 1*b* of the '880 patent illustrate a relay terminal 12 having two connecting springs 12*a*, 12*b* and projections 12*h* near the upper and lower ends of the relay terminal 12 for guiding and contacting relay pins. The two end projections 12*h* provide improved stability and simplified manufacturing techniques over tongue relays (col. 4, ll. 30–41).

U.S. Pat. No. 4,813,881, to Kirby entitled "Variable Insertion Force Contact" Issued Mar. 21, 1989 (the '881 patent) describes a dual female contact having opposed jaws of different widths. The different widths vary the force needed to engage or release pins to and from the jaws. Thus, a board or plug is more easily removed from one side than the other.

Although these devices generally functioned well and provided advantages over prior devices, the devices did not provide users with adequate adaptability, particularly with respect to use in interface for a mass interconnect system.

SUMMARY OF THE INVENTION

According to a first aspect of the invention, an electrical connector includes an elongate body having a first end, a second end, and a center section, the body being electrically conductive between the first end and the second end, each of the first end and the second end including an open socket and a contact, and at least one gimbal formed on the exterior of the center section.

According to another aspect of the present invention, a module includes a receiver module front having a body and a plurality of bores extending therethrough, a receiver module back having a body and a plurality of bores extending therethrough, and the receiver module front and the receiver module back configured and arranged to mate together.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
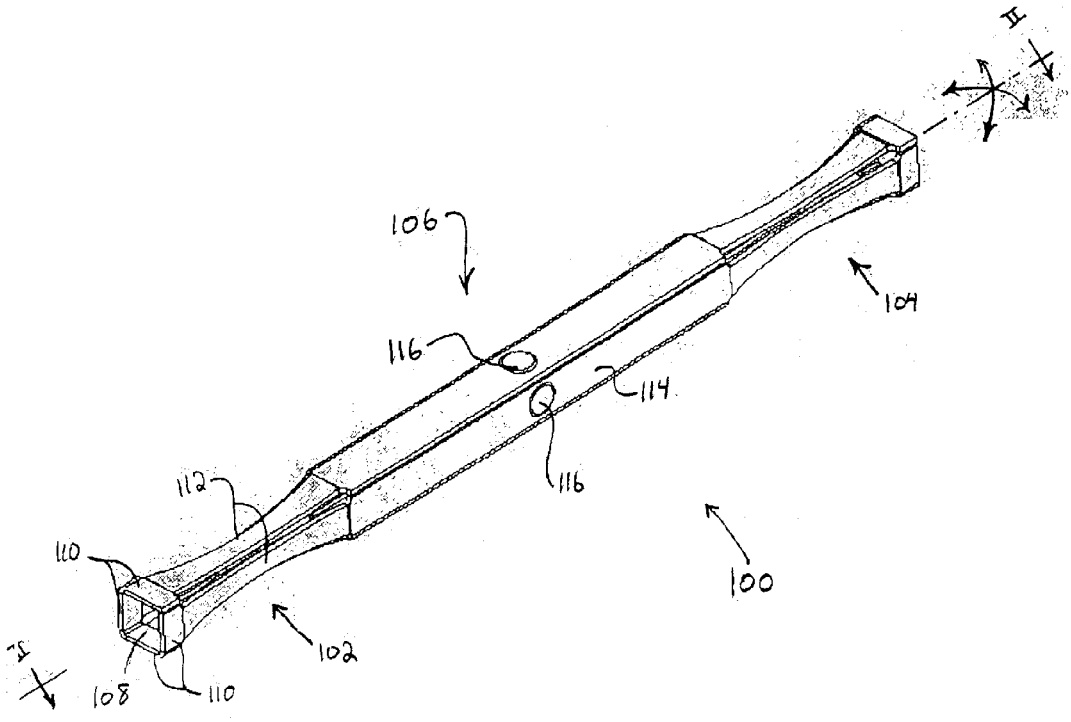
FIG. 1 illustrates a perspective view of an exemplary embodiment of an electrical connector in accordance with the present invention.

Referring to the drawing figures, like reference numerals designate identical or corresponding elements throughout the several figures.

The present invention has been made in view of the above circumstances and provides, among other things, an interface for a mass-interconnect system. The present invention also can provide an interface for a mass-interconnect system that provides an interface for multiple input modules, as well as providing a connector for mating at least two connectors having pinned interfaces. Connectors in accordance with the present invention are able to provide a socket having reliable electrical contact and a pin socket with reliable pin alignment. Furthermore, the present invention is to provide an interface for multiple input modules with reliable electrical contact and pin alignment.

Additional aspects of the invention will be set forth in part in the description which follows and in part will be clear from the description, or may be learned by practice of the invention.

FIG. 1 illustrates a perspective view of an exemplary embodiment of a connector 100 in accordance with the present invention. Connector 100 generally includes a first end 102, a second end 104, and a center section 106 positioned between the first and second ends. In this exemplary embodiment, the first end 102 and second end 104 are mirror images of one another, and therefore the descriptions herein of the structures and functions of the first end are equally applicable to the structures and functions of the second end.

The first end 102 includes a plurality of contacts 110 which surround an opening or socket 108. While the exemplary embodiment illustrated in FIG. 1 includes four contacts 110, those of skill in the art will understand that the present invention is not so limited, and the first end 102 may include fewer than or more than four contacts. For example, it may contain two contacts. The contacts 110 are connected to the center section 106 with a plurality of paddles or beams 112. Preferably, there is one beam or paddle 112 for each contact 110. Preferably, each beam 112 extends or arcs inwardly slightly, e.g., is bowed inwardly, to assist in retaining a contact pin when inserted into the socket 108.

The connector 100 is an electrical connector, and therefore is at least partially made of a material or materials that are electrically conductive such that an electrical signal or current will be communicated between the first and second ends 102, 104 of the connector.

The center section 106 of the connector 100 can take any of a number of shapes within the scope of the present invention. The exemplary embodiment illustrated in FIG. 1 includes a center section 106 which is formed of a multi-sided body 114. The embodiment of the present invention illustrated in FIG. 1 has a center section 106 that has four sides, although those of skill in the art will appreciate that any number of sides for the center section 106 can be utilized, i.e., at least one side connects the first end 102 and the second end 104.

The center section 106 of the exemplary embodiment of FIG. 1 preferably includes a gimbal feature. As will be appreciated, the gimbal feature 116 can take any number of forms, including being provided on a structure which is adjacent to the center section 106, as described in greater detail below. The gimbal feature 116 will be described in greater detail with reference to FIGS. 4–6. In general, however, the gimbal feature 116 is preferably approximately centered between the first end 102 and the second end 104, although the gimbal feature may alternatively be positioned off center with respect to the two ends of the connector 100.

Figure 2:
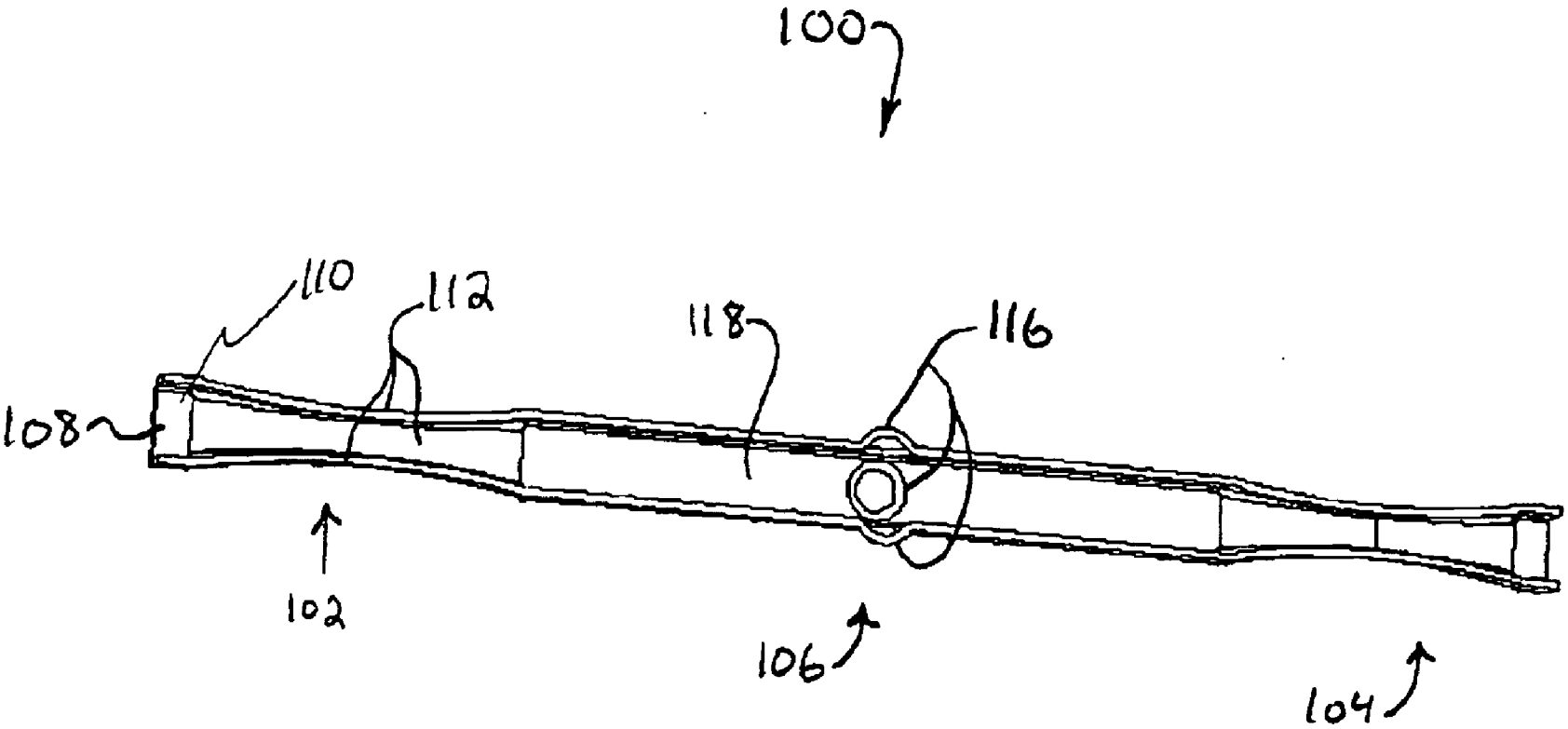
FIG. 2 illustrates a longitudinal cross-sectional view along line 11—11 in FIG. 1.

FIG. 2 illustrates a longitudinal cross sectional view of the connector 100 illustrated in FIG. 1, taken at line II—II thereof. The exemplary connector 100 may include a hollow interior 118. As will be appreciated by those of skill in the art, the interior 118 of the connector 100 may alternatively be solid or include solid portions, e.g., the sockets 108 may be formed as blind bores into the connector 108. For manufacturing purposes, however, it may advantageous to form connector 100 with a hollow interior so that it can be more easily manufactured from a sheet material that is stamped and formed into a hollow body.

Figure 3:
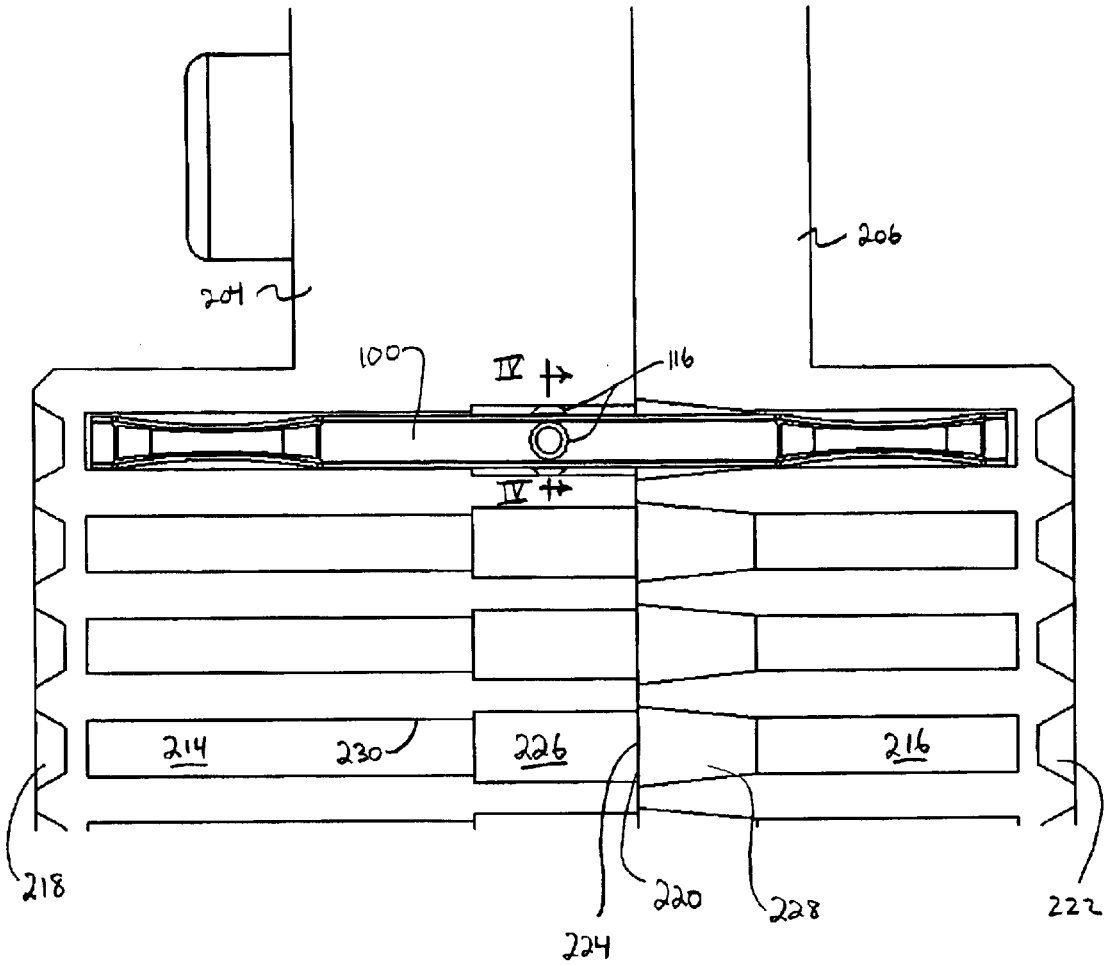
FIG. 3 illustrates a cross-sectional view of portions of an exemplary embodiment of a connector module in accordance with the present invention.
Figure 7:
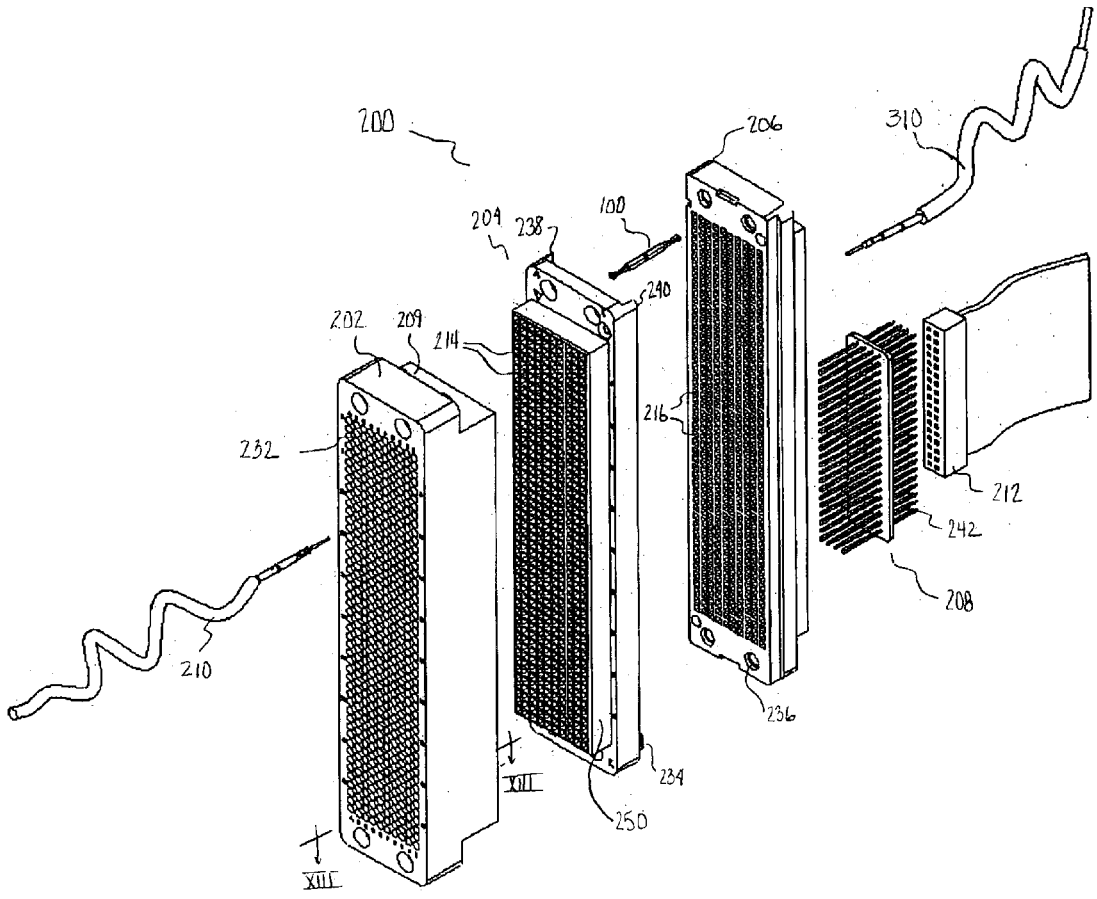
FIG. 7 illustrates an exploded perspective view of a connector module in accordance with the present invention.
Figure 8:
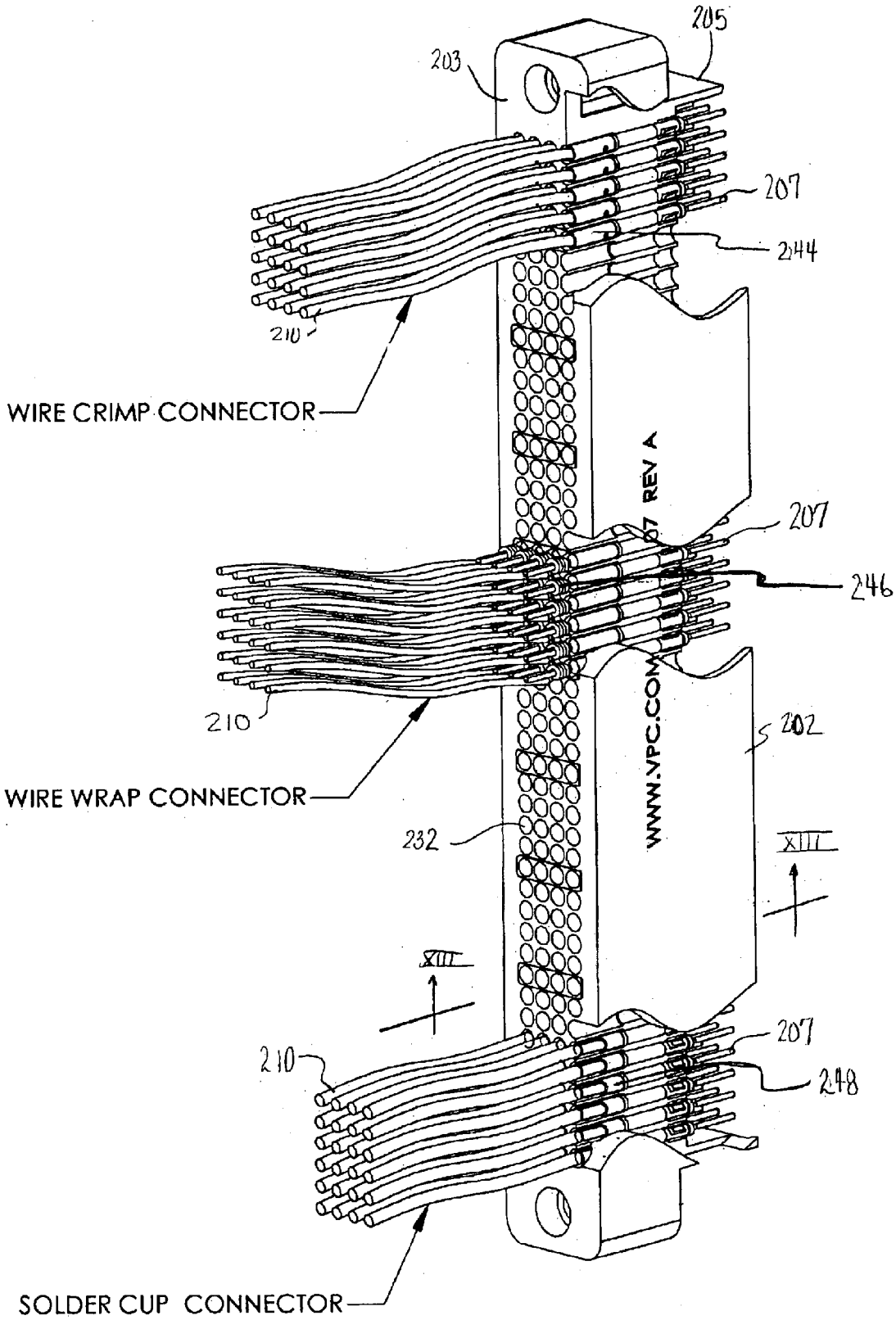
FIG. 8 illustrates a cross-sectional view taken at line XIII—XIII.

FIG. 3 illustrates the exemplary connector 100 installed in place in a connector module 200 in accordance with the present invention. Reference is also made to FIG. 7, in which an exemplary embodiment of a connector module 200 is illustrated. A receiver module front 204 is releasably connected to a receiver module back 206 so that a plurality of holes or bores 214, 216 are lined up or registered, with a connector in accordance with the present invention installed in one or more of the holes or bores. The receiver module front 204 preferably includes a plurality of bores 214, each including a first port 218 and a second port 220. Similarly, the receiver module back 206 includes, preferably, a plurality of bores 216, each including a port 222 and a port 224. The receiver module front 204 and back 206 are mutually constructed and arranged so that when they are mated together, optionally using a snap feature 234, 236, the bores 214, 216 are aligned.

As illustrated in FIG. 3, a connector in accordance with the present invention is preferably installed into the combination bore 214, 216, such that the connector is housed entirely within the bore. In order to assist in the alignment of the bores 214, 216 with the connector inserted therein, one of the bores 214, 216 preferably includes a tapered or frustoconical section 228 to help guide the connector into that bore. In the embodiment illustrated in FIG. 3, the section 228 is included in the receiver module back 206, although it may also or alternatively be formed in the receiver module front 204.

One of the receiver module front 204 and receiver module back 206 includes an enlarged section 226 in one or more of the bores 214, 216, respectively, to accommodate the gimbal feature 116, when provided on the connector 100. As illustrated in FIG. 3, the gimbal feature 116 extends outwardly from the outer surface of the connector 100, and bears against the inner surface of the enlarged section 226. As will be readily appreciated by those of skill in the art, the gimbal 116 bears against the interior surface 230 of the enlarged section 226, and inhibits or prevents movement of the connector 100 laterally within the bore 214, while permitting a pivoting motion of the connector 100 around the gimbal. With reference to FIG. 1, on the right hand side thereof, the gimbal feature permits the open socket 108 of both the first end 102 and the second end 104 to move in a surface that is generally a small portion of a sphere defined by the gimbal and the end of the connector. The effect of the gimbal permitting the movement, e.g., pivoting of the first and second ends 102 and 104 within the ends of the bores 214, 216, while at the same time restraining movement of the connector 100 in both lateral and longitudinal directions, permits the connector 100 to more easily self-align with a mating pin structure when inserted through the ports 218, 222.

Figure 4:
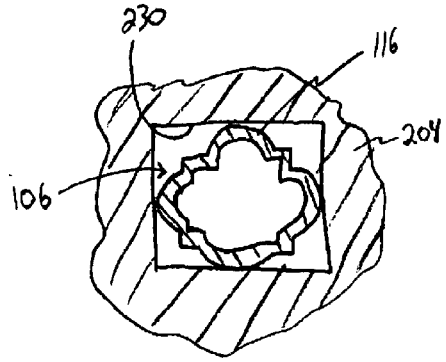
FIGS. 4–6 illustrate cross-sectional views of several embodiments of the present invention, taken at line IV—IV.
Figure 5:
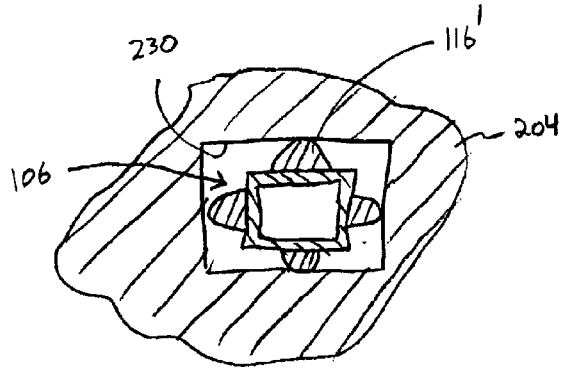
Figure 6:
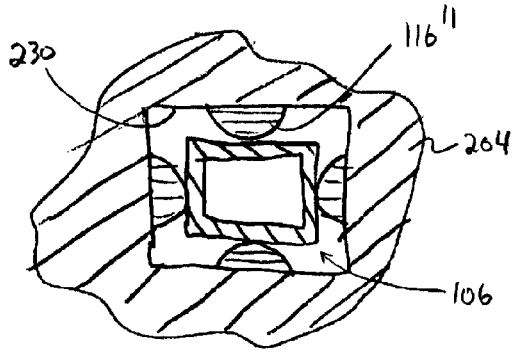

Returning now to FIGS. 4–6, several exemplary embodiments of the gimbal feature 116 are illustrated in each of FIGS. 4–6, a cross sectional view is shown taken along line IV—IV in FIG. 3. FIG. 4 illustrates the gimbal feature 116 contacting the internal sidewall 230 of the enlarged section 226. In the embodiment illustrated in FIG. 4, the gimbal feature 116 is formed integrally with and of the same material as the remainder of the center section 106 of the connector 100. As illustrated in FIG. 5, however, the gimbal feature can be formed as a separate component 116' which is joined to the remainder of the center section 106 of the connector 100. The present invention is not so limited, however, and another aspect of the present invention is the provision of the gimbal feature formed on the interior sidewall 230 of the enlarged section 226, as illustrated in FIG. 6. In the embodiment illustrated in FIG. 6, the gimbal feature 116" extends inwardly from the sidewall 230 and contacts the exterior surface of the center section 106 of the connector 100. Common among the embodiments of the gimbal feature the present invention, the gimbal feature permits a self-aligning motion by the ends of the connector 100 while restraining motion the connector itself in both lateral and longitudinal directions. Other embodiments could include gimbal features permitting self-alignment in one a horizontal or only a vertical direction. One skilled in the art would further recognize that the gimbal feature could take any of a wide variety of shapes.

According to a preferred embodiment of the present invention, the connector 100 includes the sockets 108 bounded by four contacts 110 each, and a gimbal feature 116, 116', 116" is provided on four sides of the connector 100. The provision of four contacts, with gimbals of the four faces of the contact center section 106, is advantageous because the gimbals permit the two ends 102, 104 of the connector 100 to move in two degrees of freedom, and the provision of four contacts 110 on each of the two ends of the connector helps assure that electrical contact is maintained between the connector 100 and an electrical pin inserted within the socket 108, despite the movement of the connector because of the gimbal. More specifically, when gimbals are provided on opposite sides of the center section 106, the ends 102, 104 can pivot about a line extending between the points where each gimbal bears against surface 230, or the external surface of the center section for the embodiment illustrated in FIG. 6. While such an arrangement is advantageous, other permutations of numbers of gimbals 116 and contacts 110 are also within the scope of the present invention.

Turning back to FIG. 7, a connector module 200 is in accordance with the present invention is illustrated. Receiver module front 204, connector 100, and receiver module back 206 are illustrated and adjacent to each other, and are illustrated prior to having been mated together, optionally via snap fittings 234, 236, with the connector in the bores 214, 216. An ITA module 202 is also provided with a plurality of holes or bores 232 extending from the front side 203 to the back side 205 of the ITA module 202. One or more bores 232 are configured for accepting electrical contacts in a variety of forms. Individual wire inputs 210 from one or more units under test (not shown) terminate with wire crimp contacts 244, wire wrap contacts 246, or solder cup contacts 248. A plurality of male pins 207 extend out of the bores 232 from the back side 205 of the ITA module 202 from each contact 244, 246, 248. The male pins 207 align and mate to the bores 214 in the receiver module front 204, and are sized to be received in socket 108 of connector 100. The module 202 preferably includes a skirt 209 that is sized to receive and hold therein a shoulder 250 of the receiver module front 204. The receiver module front includes a pair of extensions 238, 240 which are spaced apart a distance so that the receiver module back 206 can be inserted between the extensions and be held therein. The modules 202, 204, 206 are preferably constructed of a non-electrically conductive material.

A pin header 208 can be used with the receiver module back 206. Pin headers 208 are well known to those of ordinary skill in the art, and include a plurality of electrically conductive pins 242, which can be inserted into the ports 222. Alternatively, a wire pin 310 crimped to a single wire can be inserted into the ports 222. When a pin header 208 is used with the receiver module back 206, a ribbon cable receptacle and ribbon 212 can be plugged into the pins of pin header 242 to make electrical contact therewith, easily mating with a standard ribbon cable. The ribbon cable, wire pin 310, or the like, electrically connect to interface test equipment (not shown). It will be understood by one of ordinary skill in the art that other devices and combinations of devices having male-pinned interfaces may be mated and received through the ports 222 of the receiver module back 206, carrying electrical signals from test equipment, without departing from the scope of the present invention.

When assembled together, the structures illustrated in FIG. 7 are arranged with the ITA module 202 mounted onto the shoulder 250 of receiver module front 204, with the contact 244 inserted into the socket 108 of at least one connector 100. The connector 100 is mounted within the receiver module 204 and back 206, which are held together, optionally at a snap fitting 234, 236. The pins 242 of pin header 208 are inserted through the ports 222 of the receiver module back 206, and the ribbon cable of 212 or the like is mounted on the pin header 208. Alternatively, instead of the pin header 208, one or more of the wire pins 210 crimped to a single wire can be inserted into the ports 222 to make electrical connection there through with the connector 100.

Figure 9:
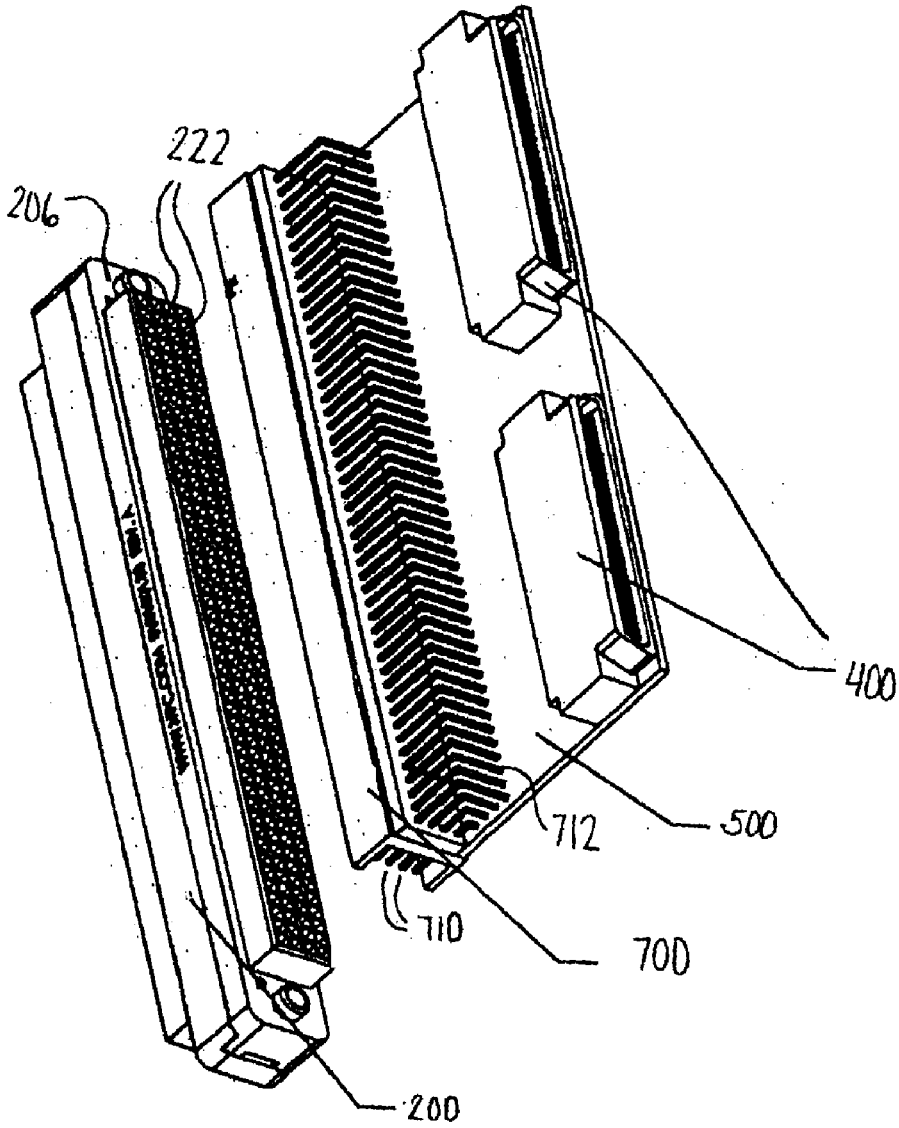
FIG. 9 illustrates an alternative embodiment of an interface in accordance with the present invention.

Referring to FIG. 9, an alternative interface arrangement in accordance with the present invention is illustrated. The module 200 of the present invention is mated to a right angle connector 700. The right angle connector 700 has a first male pinned interface 710 which mates to the bores 222 of the back side 206 of the connector module 200. The right angle connector 700 mates to a printed circuit board 500, having one or more industry-standard, board-mount connectors 400, through a second male-pinned interface 712. Test equipment (not shown) electrically connects to the circuit board through the board-mount connectors 400 with a commercially available cable assembly. While the interface of FIG. 9 illustrates an interface including a right angle connector, it will be appreciated by one of ordinary skill in the art that the dual female connector of the present invention may interface between a wide variety of devices having male-pinned interfaces without departing from the scope of the present invention.

While the invention has been described in detail with reference to preferred embodiments thereof, it will be apparent to one skilled in the art that various changes can be made, and equivalents employed, without departing from the scope of the invention. Each of the aforementioned documents is incorporated by reference herein in its entirety.

What is claimed is:

1. An interface for electrically connecting a at least one test device and a unit under test comprising:

an interface test adapter module comprising a front side and a back side, and a plurality of bores extending there-through, a plurality of contacts disposed in the bore, each contact comprising an open end along the front side for receiving a first male-pinned connector and a male-pinned end extending from the back side;

an electrical connector comprising a front side comprising a plurality of male-pinned connectors and a back side electrically connected to the at least one test device; and a receiver module comprising a front side and a back side, and a plurality of bores extending from the front side to the back side, and a plurality of dual female contacts comprising a first opening at the front side and a second opening at the back side, the dual female contacts disposed in said bores;

wherein the male-pinned end of the interface test adapter module mates within the first opening of the contact at the front side of the receiver module, and the plurality of male-pinned connectors of the electrical connector mate within the second opening of the contacts at the back side of the receiver module.

2. The interface of claim 1, wherein each of the plurality of dual female contacts further comprises at least one gimbal.

3. The interface of claim 1, wherein the electrical connector is selected from the group consisting of: a pin header, a right angle connector, and a wire pin.

4. The interface of claim 3, wherein the electrical connector is a pin header and the interface further comprises a ribbon cable mounted on the pin header.

5. The interface of claim 3, wherein the electrical connector is a right angle connector, a printed circuit board, and a ribbon cable.

* * * * *

UNITED STATES PATENT AND TRADEMARK OFFICE

CERTIFICATE OF CORRECTION

PATENT NO. : 6,869,321 B1 
DATED : March 22, 2005
INVENTOR(S) : Darryl Marshall Ashby, Jeffrey Paul Stowers and David Lawrence Rocker It is certified that error appears in the above-identified patent and that said Letters Patent is hereby corrected as shown below:

Column 6,
Line 31, delete "a" after "connecting"

Signed and Sealed this

Twenty-fourth Day of May, 2005

JON W. DUDAS
*Director of the United States Patent and Trademark Office*